United States Patent [19]

Deisting

[11] 4,044,675

[45] Aug. 30, 1977

[54] PRINTING DEVICE HAVING A SLIDING CARRIAGE

[75] Inventor: Horst Jürgen Deisting, Berlin, Germany

[73] Assignee: Adrema Pitney Bowes GmbH, Heppenheim, Bergstrasse, Germany

[21] Appl. No.: 617,660

[22] Filed: Sept. 29, 1975

[30] Foreign Application Priority Data

Oct. 7, 1974 Germany ..... 2447714

[51] Int. Cl.[2] ..... B41F 3/20

[52] U.S. Cl. ..... 101/269; 101/45; 101/260

[58] Field of Search ..... 101/260, 269, 45, 55, 101/56, 66

[56] References Cited

U.S. PATENT DOCUMENTS

| | | | |
|---|---|---|---|
| 930,781 | 6/1890 | Lingner | 101/269 X |
| 1,065,951 | 7/1913 | Magrane | 101/269 X |
| 1,523,736 | 1/1925 | Wagner | 101/269 |
| 2,935,939 | 5/1960 | Doherty et al. | 101/269 |
| 3,417,691 | 12/1968 | Kubovy | 101/269 |
| 3,654,858 | 4/1972 | Rick | 101/269 |
| 3,678,851 | 7/1972 | Steidinger et al. | 101/260 |
| 3,818,829 | 6/1974 | Patterson, Jr. | 101/269 |

*Primary Examiner*—Edgar S. Burr
*Assistant Examiner*—William Pieprz
*Attorney, Agent, or Firm*—Peter Vrahotes; William D. Soltow, Jr.; Albert W. Scribner

[57] ABSTRACT

This invention relates to a printing device of the type having a carriage which supports a printing roll. In order to perform the printing operation, the carriage is pivotally and slidably mounted on a slide rod. An arm of the carriage is mounted in a housing and is provided with a guide roller that is located in the same vertical plane as the printing roll. The guide roller cooperates with a guide means that extends parallel to the slide rod to keep the printing roll in engagement with a printing anvil and to enable the printing roll to swing upwardly into a raised position when arriving at one of the ends of the slide rod.

2 Claims, 3 Drawing Figures

PRINTING DEVICE HAVING A SLIDING CARRIAGE

BACKGROUND OF THE INVENTION

Printing devices which utilize a removable plate, such as a credit card, of the aforementioned kind, are well known in the art, as exemplified in the German patent DT-PS 1,279,034. Such printing devices usually have a carriage made up of two arms. One arm extends forwardly from the middle area of the carriage, through which area a slide rod is received, and serves as a printing arm by supporting a printing roll. The second arm, which extends substantially into the opposite backward direction, bears a guide roller which cooperates with a guide rod extending parallel to the slide rod and mounted in the housing. In this type of machine, all the forces of reaction resulting from action on a printing anvil by the printing roll are absorbed by the carriage, by the slide rod, the guide rod, and the housing bearing both these rods. As a consequence, it is essential to use a relatively sturdy and rigid carriage slide rod, guide rod and housing, to afford reliable operation over extended periods of use. For this purpose, all the essential parts of the device, particularly the carriage, have to be made out of castings. This results in a relatively expensive and heavy device in order to obtain the required endurance.

SUMMARY OF THE INVENTION

According to the instant invention, an improved printing device of the aforementioned kind is provided so that reliable operation and endurance is achieved in spite of a simpler design and the usage of less expensive structural elements.

The printing device according to the instant invention is essentially characterized in that the carriage is U-shaped, with a slide rod passing through a flange which joins both its arms. A bearing of the printing roll is mounted on one of the carriage arms and extends above a printing anvil. The other arm of the carriage, which extends below the printing anvil, supports a guide roller whose guiding path is defined by a groove provided at the lower portion of the printing anvil. In the operation of the device, only the carriage has to be sufficiently resistant to bending, as the forces of reaction resulting from the printing action in this device are not transmitted to the slide rod nor to the housing. As a consequence, the housing as well as the slide rod now may be comparatively weaker and smaller. The sturdier guide rod, required for the conventional printing device, may be entirely omitted, including its expensive and sturdy mounting within the housing.

A carriage which is suitably resistant to bending but easily formed consists of two U-shaped sheet metal sections jointly connected, spaced apart and extending at parallel levels to each other. The required rigidity is attained in spite of using only relative inexpensive materials, namely, simple sheet metal.

The two U-shaped sheets are connected to each other in the area of their legs by means of angle sheets which serve as bearings for the printing roll shaft and the guide roller shaft, respectively.

It has been found advantageous from a construction point of view to provide the lower legs of the U-shaped sheets with angular marginal sections that are bent so as to face each other and to bear the angle sheet which serves to mount the shaft of the guide roller.

It has been found further advantageous to provide the bottom of the printing anvil with a flange which extends over its entire length and into which is located an elongated aperture which serves as a track for the guide roller. The carriage, together with its upper legs carrying the printing roll, automatically swings upwardly when arriving at the end positions of the groove in the extending anvil by having upwardly inclined sections at both ends of the aperture.

BRIEF DESCRIPTION OF THE DRAWING

The features and advantages of the present invention will become more readily apparent from the following detailed description when considered together with the accompanying drawing, wherein.

DESCRIPTION OF THE PREFERRED EMBODIMENT

Figure 1:
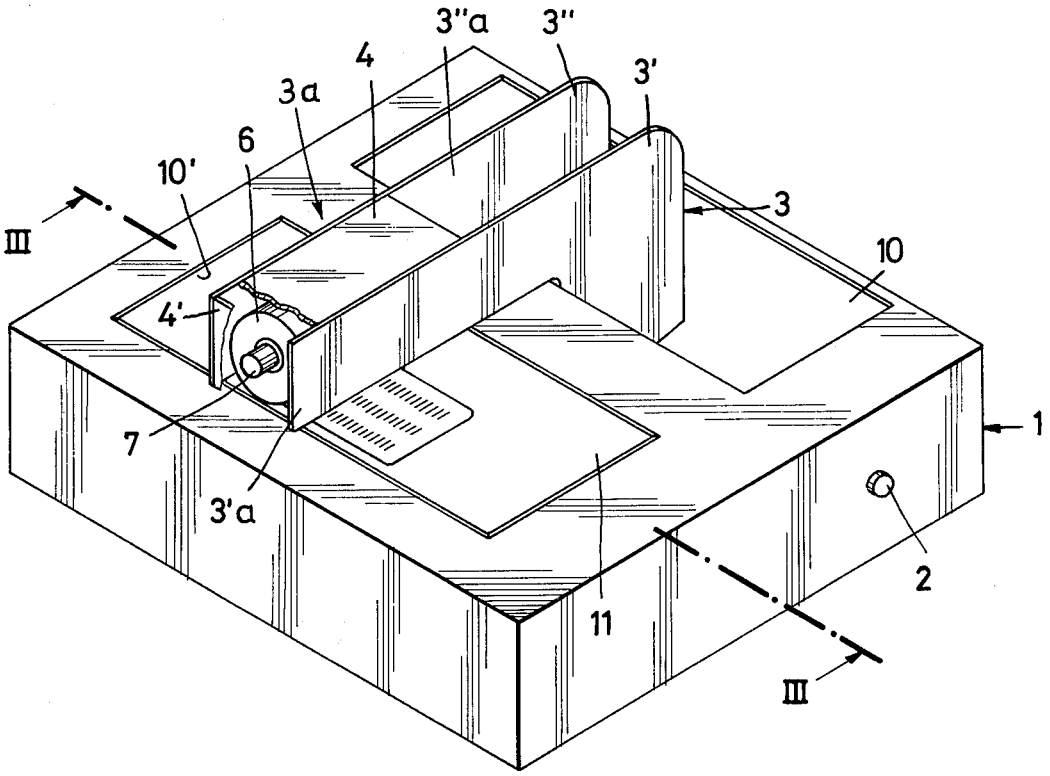
FIG. 1 is a perspective schematic view of a printing device embodying the principles of the invention.

With reference to the drawing, the printing device includes a rectangular housing 1 having the ends of a slide rod 2 mounted in its lateral sides, which slide rod extends over the entire length of the housing.

Figure 2:
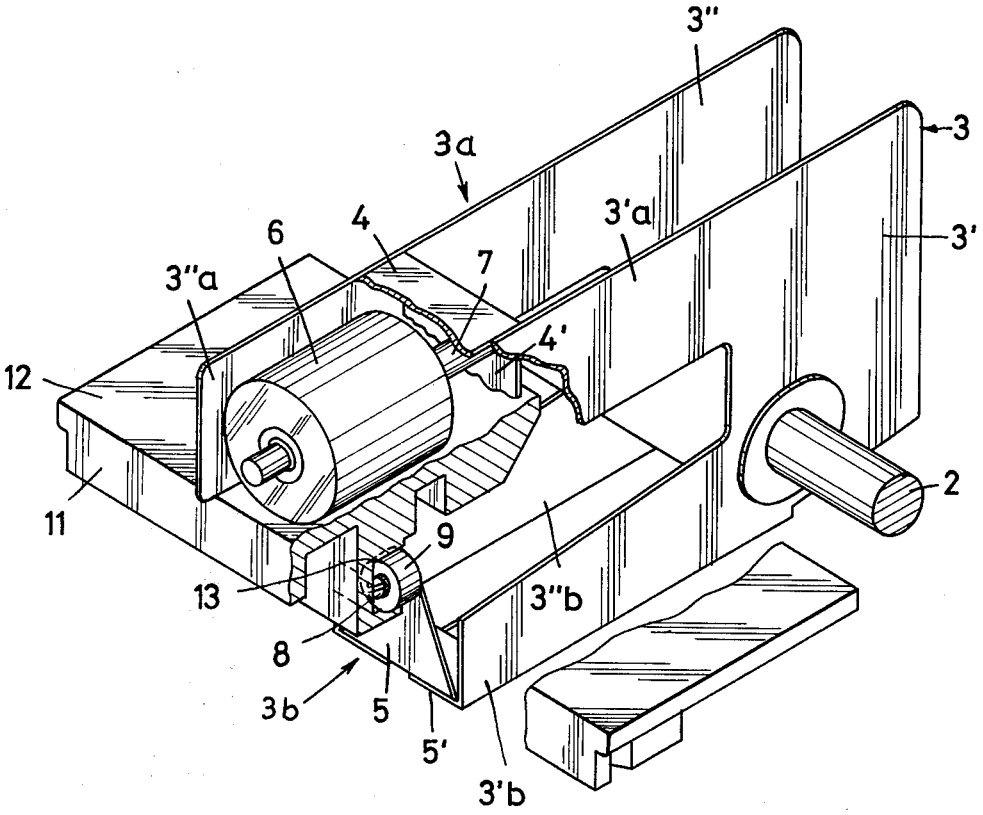
FIG. 2 is a partial, perspective view with cut-out portions of the principal parts of the printing device according to the invention as shown in FIG. 1.

A carriage 3 is slidably and pivotally mounted on the slide rod 2, to allow longitudinal movement along the housing 1 and pivotal movement about the slide rod. This carriage 3 has two U-shaped sheets 3', 3'' extending in a spaced apart relationship at parallel levels to each other. Each U-shaped sheet 3', 3'' has extended the upper arm section 3'*a*, 3''*a* and extended bottom arm section 3'*b*, 3''*b* respectively. A sheet 4 serves the purpose of joining the upper arm sections 3'*a* and 3''*a*, thereby forming an upper arm 3*a* and a generally triangular-shaped angled sheet 5 uniting the lower arm sections 3'*b* and 3''*b* thereby forming a lower arm 3*b*. A pair of spaced plates 4' are disposed between the upper arm sections 3'*a* and 3''*a* to provide structural rigidity thereto. As it is apparent from the FIG. 2, a printing roll 6 is rotatably mounted on a shaft 7 which is received between the upper arm sections 3'*a* and 3''*a* of the carriage 3.

In a similar way, the angled sheet 5 serves as a bearing member for a shaft 8 of a guide roller 9. The angled sheet 5 is mounted on inwardly flanged portions 5' of the bottom arm sections 3'*b*, 3'*b*. The printing roll 6 and the guide roller 9 are located in the same plane, which plane is perpendicular to the printing anvil surface 12, as described below.

Referring to FIG. 1, the housing 1 has a pair of generally rectangular openings 10 and 10'. The carriage 3 is received in one of the openings 10 and the bottom arm 3*b* extends into the interior of the housing 1 below the other opening 10'. A printing anvil 11 is received within the opening 10' and has a surface 12 that is flush with the upper surface of the housing 1. The anvil 11 is operative to receive a printing plate 14, as for example, a credit card made of a plastic material at its upper surface 12. The upper arm 3*a* of the U-shaped carrige 3 extends over the anvil surface 12.

Figure 3:
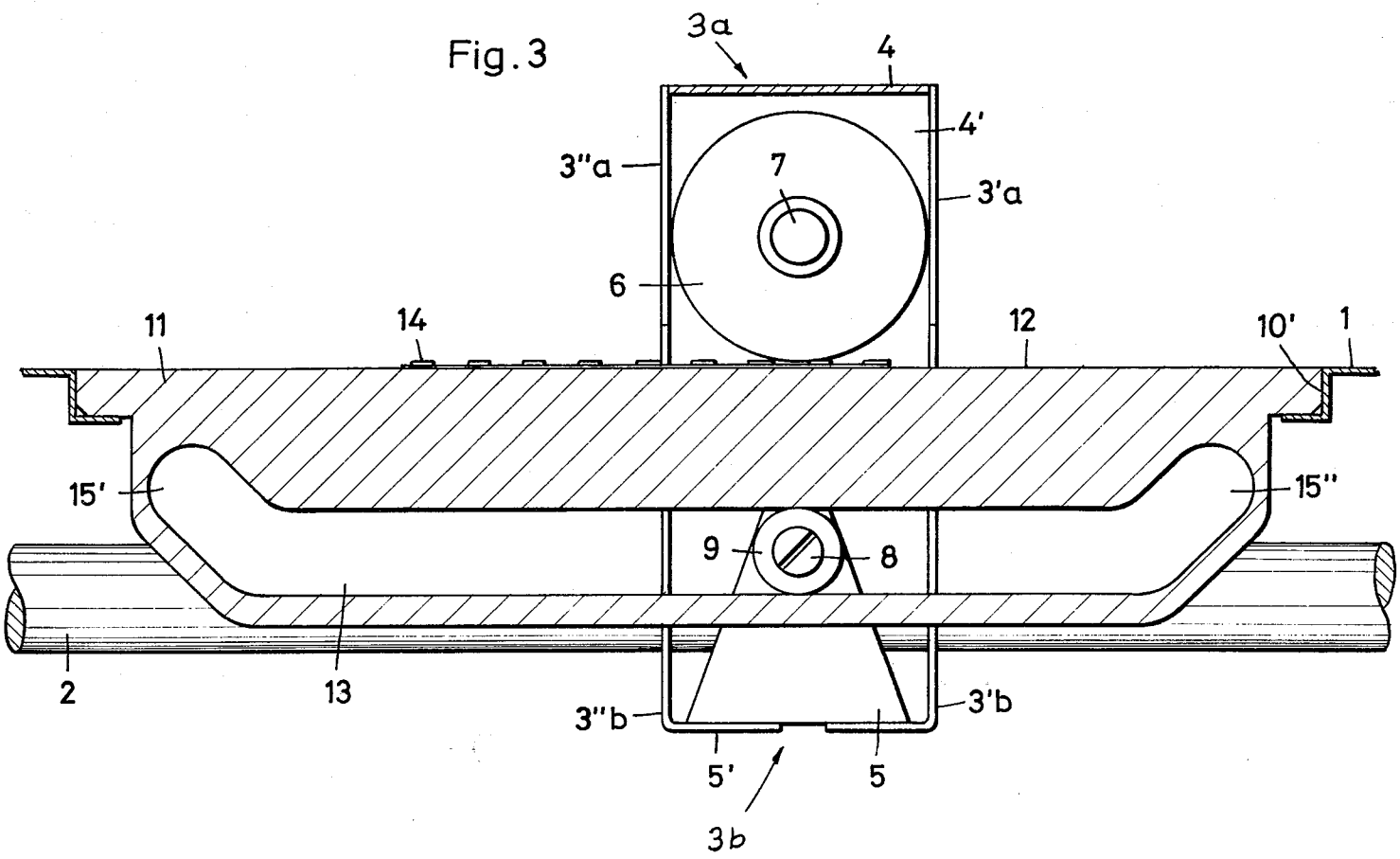
FIG. 3 is a longitudinal cross sectional view of the device, taken along the lines 3-3 of FIG. 1.

An elongated aperture 13 is provided within the printing anvil 11 and extends along virtually the entire length of the anvil. As can be seen in FIG. 3, the guide roller 9 is mounted within the angled sheet 5 and extends into the aperture 13. The aperture 13, which extends generally parallel to the printing anvil surface 12, terminates at its end into areas 15' and 15" which are upwardly inclined in the direction to the printing anvil surface 12. In this way, the carriage 3 is pivoted upwardly about the slide rod 2 when arriving at one of its end positions. In this case, the upper arm 3*a*, which carries the printing roll 6, is lifted from the printing anvil surface 12 to disengage the printing roll from the anvil 11. Intermediate the end positions of the carriage 3, the printing roll 6 will be in printing engagement with the anvil 11.

Having the printing roll 6 and the guide roll 9 located within the same plane, which plane is perpendicular to the printing anvil 11, has been found to be particularly advantageous. This combination results in less stress being applied to the U-shaped carriage 3, thereby allowing it to be fabricated from less expensive components. Additionally, no load is applied to the other components such as the housing 1 and the slide rod 2.

What is claimed is:

1. A printing device of the type to be operated in conjunction with a printing plate such as a credit card, the combination comprising:

a housing having at the upper portion thereof a pair of parallel, longitudinally extending openings, a longitudinally extending rod disposed within said housing below the first of said openings, a longitudinally extending anvil member, operative to receive and hold a printing plate, fixedly received within the second of said openings, said anvil having at its lower portion thereof a longitudinally extending aperture with upturned ends, a U-shaped carriage having a base and a pair of arms extending laterally from said base, said base being received within said first opening and slidably and pivotably supported upon said rod, the first of said arms extending outside said housing and over said anvil, the second of said arms extending within said housing, said first arm at its end distal from said base rotatably supporting a printing roll over said anvil, said second arm at its end distal from said base rotatably supporting a guide roll which is received within said aperture, the axis of said printing roll and said guide roller being parallel to one another, said printing roll and said guide roller being vertically aligned relative to one another and perpendicular to said anvil, whereby said carriage is operative to be slid along said rod and to be pivoted upwardly when said guide roller is received within said upturned ends of said aperture thereby maintaining said printing roll is printing engagement with said anvil when located intermediate said aperture ends and disengaging said printing roll from said anvil when said guide roll is received by one of the said aperture ends.

2. The printing device of claim 1 wherein said carriage comprises a pair of opposed U-shaped sheet metal members, each member having an upper arm section and a lower arm section, a laterally extending connection member secured to the upper edges of said upper arm sections, a pair of longitudinally extending plates secured by and located between said upper arm sections, a first shaft disposed between and supported by said plates, said first shaft rotatably supporting said printing roll, a longitudinally extending lower sheet metal member secured by and located between said lower arm sections, and a second shaft is mounted by said lower sheet metal member, said second shaft rotatably supporting said guide roller.

* * * * *

UNITED STATES PATENT AND TRADEMARK OFFICE

CERTIFICATE OF CORRECTION

PATENT NO. : 4,044,675

DATED : August 30, 1977

INVENTOR(S) : Horst Jurgen Deisting

It is certified that error appears in the above-identified patent and that said Letters Patent are hereby corrected as shown below:

Column 2, line 51, change "3'b,3'b" to --3'b,3"b--.

Column 2, line 64, change "carrige" to --carriage--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*